US005455305A

United States Patent [19]

Galambos

[11] Patent Number: 5,455,305

[45] Date of Patent: Oct. 3, 1995

[54] PROPYLENE POLYMER YARN AND ARTICLES MADE THEREFROM

[75] Inventor: Adam F. Galambos, Bear, Del.

[73] Assignee: Montell North America Inc., Wilmington, Del.

[21] Appl. No.: 90,831

[22] Filed: Jul. 12, 1993

[51] Int. Cl.[6] ..... C08L 23/12; C08L 23/14

[52] U.S. Cl. ..... 525/240; 428/94; 428/96; 428/267

[58] Field of Search ..... 428/94, 96, 267; 525/240

[56] References Cited

U.S. PATENT DOCUMENTS

| | | | |
|---|---|---|---|
| 3,657,062 | 4/1972 | Eshima et al. | 161/173 |
| 3,808,304 | 4/1974 | Schirmer | 264/289 |
| 3,852,948 | 12/1974 | Ruddell et al. | 57/140 R |
| 4,296,022 | 10/1981 | Hudson | 260/42.46 |
| 4,839,211 | 6/1989 | Wilkie et al. | 428/89 |
| 4,882,222 | 11/1989 | Talley et al. | 428/362 |
| 5,058,371 | 10/1991 | Yu et al. | 57/239 |
| 5,102,713 | 4/1992 | Corbin et al. | 428/92 |

FOREIGN PATENT DOCUMENTS

| | | |
|---|---|---|
| 0414047 | 8/1990 | European Pat. Off. . |
| 0552810 | 1/1993 | European Pat. Off. . |
| 0598224 | 10/1993 | European Pat. Off. . |

*Primary Examiner*—W. Robinson Clark

[57] ABSTRACT

Polyolefin yarn capable of increased shrinkage comprising continuous strand of multiple monofilament fibers or staple fibers of propylene polymer material consisting essentially of at least about 5 parts by weight, but less than 50 parts by weight of syndiotactic propylene polymer having a syndiotactic pentad fraction of 0.7 or more, blended with crystalline isotactic propylene polymer, each propylene polymer material independently selected from the group consisting of:

(I) homopolymers of propylene; and (II) random crystalline propylene copolymers, terpolymers or both, consisting essentially of from about 80 to about 98.5% of propylene; and from about 1.5 to about 20.0% of at least one comonomer selected from the group consisting of ethylene and $C_4$–$C_8$ alpha-olefins; said copolymer preferably containing from about 2 to about 10% ethylene when said $C_4$–$C_8$ alpha-olefin is not present; and said terpolymer preferably containing from about 0.5 to about 5% ethylene when said $C_4$–$C_8$ alpha-olefin is present; and including mixtures of such copolymers and terpolymers, wherein said amounts are expressed as weight %. Fabric, especially pile fabric such as carpeting is disclosed which is made from the yarn and has improved appearance retention properties.

19 Claims, No Drawings

PROPYLENE POLYMER YARN AND ARTICLES MADE THEREFROM

FIELD OF THE INVENTION

Yarn produced from fibers of propylene polymer material. More particularly, it relates to yarn and pile fabric such as carpeting made therefrom, in which the fiber is based on compositions comprising mixtures of isotactic and syndiotactic crystalline polypropylene and crystalline and semicrystalline random copolymers of propylene with ethylene and $C_4$–$C_8$ alpha-olefins.

BACKGROUND OF THE INVENTION

In addition to its significant use in structural elements such as molded parts, polypropylene has found significant use as a fiber and in yarn, particularly carpet yarn. In order to capitalize on its strength, high melting point and chemical inertness, as well as low cost, the polymer typically used for such applications has been the isotactic crystalline homopolymer of polypropylene (referred to as "iPP"). However, carpeting made from this polymer has limited recovery of the pile height after compressive stress (resiliency) and tuft ends which are susceptible to opening up after wear (tuft coherency). Such performance deficiencies have limited its use in domestic saxony type carpet construction. Earlier attempts to improve isotactic polypropylene homopolymer performance were made by modifying the method of crimping the fibers comprising the yarn, U.S. Pat. No. 3,686,848.

Fibers obtained from mechanical blends of homopolymers of polypropylene and polyethylene are known; the thermoshrinkable values of such fibers are good and not very temperature dependent. However, such fibers have the disadvantage of not being very wear-resistant, since they are prone to "fibrillation": the single fiber, after having been subjected to mechanical stress, when examined under a microscope shows longitudinal tears. Such fibrillation is very evident during the manufacture of carpets, and it makes such blends undesirable for this use.

The limited resiliency of polypropylene in carpeting and other fiber/fabric applications is also discussed in "Textile Science and Technology, Polypropylene Fibers-Science and Technology" by M. Ahmed, (Elsevier Press). That reference acknowledges that polypropylene based on commercial fibers is considered intermediate in resilience characteristics between polyester and nylon although "specially prepared fibers" may surpass nylon and approach wool. The reference presents a graph (FIG. 6) that shows resilience, as measured by pile retention, affected by heat setting and draw ratio. It is stated that "(t)here is general agreement that resilient fiber must exhibit high crystalline orientation and high fraction of a-axis oriented crystallites."

A different form of crystalline, high molecular weight polypropylene currently receiving significant attention is identified as syndiotactic polypropylene (referred to as "sPP") although this type of polyolefin was first disclosed by Natta et al. in U.S. Pat. No. 3,258,455. Commercially valuable forms of sPP are produced using members of a family of catalysts known as metallocene catalysts. Metallocene or homogeneous catalysts have been developed more recently, as disclosed by J. A. Ewen et al. (e.g., U.S. Pat. No. 4,794,096), J. M. Canich (U.S. Pat. No. 5,026,798), W. Kaminsky and others. The Canich patent includes a comprehensive discussion of "tacticity" starting at column 2 and continuing through column 7, all of which is incorporated herein by reference. Briefly, alpha-olefin polymers, particularly propylene polymers, have hydrocarbyl groups pendant from the polymer backbone chain. With reference to the polymer backbone chain, these pendant hydrocarbyl groups may be arranged in different stereochemical configurations, including atactic, isotactic and syndiotactic. The type and extent of each form of tacticity (as well as molecular weight, molecular weight distribution, and the use of comonomers) can have a significant role in determining properties. References in disclosures such as Canich to properties are typically stated in general terms, e.g., "(t)he resins that are prepared in accordance with this invention can be used to make a variety of products including films and fibers." (col. 17, lines 22–24).

A specific disclosure of the use of sPP in fiber applications appears in European Patent Application EP 0 414 047 (A. Tadashi, et al.). Tadashi teaches that, to obtain a polypropylene fiber of high strength using a mixture of iPP and sPP it is necessary to strictly limit the composition in certain respects: (1) the ratio of intrinsic viscosity of each of the two kinds of polypropylene must be within a specified range; (2) the sPP must have a syndiotactic pentad fraction of 0.7 or above and be present at a concentration of at least 50 parts by weight; and (3) correspondingly, the iPP concentration cannot exceed 50 parts by weight. The reference teaches that iPP is "a little inferior in fiber strength" so that improvement in this regard is desired and the advance which achieves the desired result is the use of at least 50 parts or more by weight of sPP in a composition containing sPP and iPP. As stated by Tadashi, "(i)f the amount of an isotactic polypropylene is more than 50 parts by weight, the strength of the resulting fiber will unpreferably be insufficient." (col.3, lines 46–49). However, Tadashi fails to recognize that other useful fiber properties can be obtained using compositions in which the sPP content is less than 50 parts by weight or in which the iPP is the predominant polymer component; such improvements are disclosed herein.

SUMMARY OF THE INVENTION

It has been surprisingly found that polyolefin yarn capable of improved properties, including increased resiliency and shrinkage, particularly useful in pile fabric and carpeting can be produced comprising continuous strand of multiple monofilament fibers (bulk continuous filament and staple) of propylene polymer material consisting essentially of at least about 5 parts by weight, but less than 50 parts by weight of syndiotactic propylene polymer blended with isotactic propylene polymer. In one embodiment the each propylene polymer material is a homopolymer of propylene; in another embodiment each polymer is a random crystalline copolymer or terpolymer consisting essentially of propylene with defined lesser amounts of one or more comonomer selected from the group consisting of ethylene and $C_4$–$C_8$ alpha-olefins.

In another embodiment, polyolefin yarn of increased resiliency and shrinkage is produced from a fiber comprising a blend of propylene homopolymer for one of isotactic or syndiotactic propylene polymer and a copolymer based on one or more of the above identified comonomers for the other.

DETAILED DESCRIPTION OF THE INVENTION

All percentages and parts in this patent specification are by weight unless stated otherwise.

The synthetic polymer resin formed by the polymerization of propylene as the sole monomer is called polypropylene.

The well-known crystalline polypropylene of commerce is a normally solid, predominantly isotactic, semi-crystalline, thermoplastic homopolymer formed by the polymerization of propylene by Ziegler-Natta catalysis. In such catalytic polymerization the catalyst is formed by an organic compound of a metal of Groups I–III of the Periodic Table, (for example, an aluminum alkyl), and a compound of a transition metal of Groups IV–VIII of the Periodic Table, (for example, a titanium halide). A typical crystallinity is about 60% as measured by X-ray diffraction. As used herein, semi-crystalline means a crystallinity of at least about 5–10% as measured by X-ray diffraction. Also, the typical weight average molecular weight (Mw) of the normally solid polypropylene of commerce is 100,000–4,000,000, while the typical number average molecular weight (Mn) thereof is 40,000–100,000. Moreover, the melting point of the normally solid polypropylene of commerce is from about 159–°169° C., for example 162° C.

As noted above, syndiotactic polypropylene differs from isotactic polypropylene in that it is produced using a different and newly developed family of catalysts based on metallocene and aluminoxane; suitable catalysts are described in the literature for producing sPP. Useful sPP should be "highly" syndiotactic. One means of characterizing such a property is by reference to the pentad fraction as defined by A. Zambelli et al. in Macromolecules, Vol. 6, 925 (1973) and ibid. Vol. 8, 687 (1975) using $^{13}$C-NMR. The syndiotactic pentad fraction of polymers useful herein should be 0.7 or higher, e.g., 0.8. Suitable catalyst systems are described in EP 0 414 147 (Tadashi et al.), supra, as well as in the Ewen and Canich references, all of which are incorporated by reference. An example of the catalyst system which can be used for the preparation of sPP useful in the present invention is disclosed in EP 0 414 047 as comprising a transition metal compound having an asymmetric ligand and an aluminoxane, attributed to Ewen et al. (J. Am. Chem. Soc., 1988, 110, 6255–6256). An example of the preferred catalyst system for the production of syndiotactic polypropylene comprises a transition metal compound and an aluminoxane. The transition metal compound includes isopropyl(cyclopentadienyl-1-fluorenyl)hafnium dihalogen, isopropyl(cyclopentadienyl-1-fluorenyl)-zirconium dihalogen, and those transition metal compounds in which at least one of the halogen atoms is replaced by an alkyl group. Generic compounds are represented by the following formula wherein R is a hydrocarbon residue of 1–3 carbon atoms:

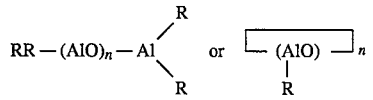

The compounds in which R is a methyl group, i.e., methylaluminoxane, and n is 5 or more, preferably 10 or more, are particularly useful. The proportion of the aluminoxane used is 10 to 1,000,000 mole times, usually 50 to 5,000 mole times based on the foregoing transition metal compound. There are no particular restrictions on the polymerization process, so that a solution process utilizing inert solvents, a bulk polymerization process in the substantial absence of inert solvents and a gas phase polymerization process may be used. It is common to conduct the polymerization at a temperature of −100° to 200° C. and a pressure of atmospheric to 100 kg/cm$^2$G. Temperatures of −100° to 100° C. and pressures of atmospheric to 50 kg/cm$^2$G are preferred.

The sPP obtained from such a process generally has a narrow molecular weight distribution useful for preparing fibers. The preferred molecular weight, expressed in terms of intrinsic viscosity measured in tetralin solution at 135° C. is about 0.1 to 3.0. Additionally, sPP is reported to be available commercially from Fina, Inc., Dallas, Texas and Mitsui Toatsu Chemicals, Japan.

As used herein propylene polymer material means syndiotactic propylene polymer having a syndiotactic pentad fraction of 0.7 or more, and crystalline isotactic propylene polymer, each propylene polymer material selected from the group consisting of: (I) homopolymers of propylene; and (II) random crystalline propylene copolymers, terpolymers or both, consisting essentially of from about 80 to about 98.5% of propylene; preferably about 90 to about 95%, more preferably about 92 to about 94% of propylene; and from about 1.5 to about 20.0% of at least one comonomer selected from the group consisting of ethylene and $C_4$–$C_8$ alpha-olefins. When a $C_4$– $C_8$ alpha-olefin is not present, the copolymer preferably contains from about 2 to about 10% ethylene, more preferably from about 7 to about 9%. When a $C_4$–$C_8$ alpha-olefin is present, the terpolymer preferably contains from about 0.5 to about 5%, more preferably about 1 to about 3% ethylene and from about 2.5 to about 10.0%, preferably about 3 to about 7%, more preferably about 4.0 to about 6.0% of an olefin selected from the group consisting of $C_4$–$C_8$ alpha-olefins. Included also are mixtures of such copolymers and terpolymers.

The polyolefin yarn of the present invention, which yarn is capable of increased resilience and shrinkage and improved performance characteristics, particularly in saxony construction carpeting, comprises a polymer composition consisting essentially of at least about 5 parts by weight, but less than 50 parts by weight; preferably about 10 parts to about 45 parts; more preferably about 15 parts to about 40 parts; most preferably about 20 parts to about 35 parts of syndiotactic propylene polymer having a syndiotactic pentad fraction of 0.7 or more blended with crystalline isotactic propylene polymer material, each propylene polymer material selected as described above.

The propylene polymer material is preferably a polymer having a melt flow rate (MFR, according to ASTM D-1238, measured at 230° C., 2.16 kg) of from about 5 to 100, preferably from about 15 to 50, more preferably from about 15 to 40. This can be accomplished by "visbreaking" a polymer having an original MFR of from about 0.5 to 10, preferably from about 0.8 to 5, or, alternatively, the propylene polymer material can be produced directly in the polymerization reactor to the preferred MFR.

The process of visbreaking crystalline polypropylene (or a propylene polymer material) is well known to those skilled in the art. Generally, it is carried out as follows: propylene polymer or polypropylene in "as polymerized" form, e.g., flaked or pelletized, has sprayed thereon or blended therewith, a prodegradant or free radical generating source, e.g., a peroxide in liquid or powder form or absorbed on a carrier, e.g., polypropylene (Xantrix 3024 additive concentrate, manufactured by HIMONT U.S.A., Inc). The polypropylene or propylene polymer/peroxide mixture is then introduced into a means for thermally plasticizing and conveying the mixture, e.g., an extruder at elevated temperature. Residence time and temperature are controlled in relation to the particular peroxide selected (i.e., based on the half-life of the peroxide at the process temperature of the extruder) so as to effect the desired degree of polymer chain degradation. The net result is to narrow the molecular weight distribution of the propylene containing polymer as well as to reduce the overall molecular weight and thereby increase the MFR relative to the as-polymerized polymer. For example, a polymer with a fractional MFR (i.e., less than 1), or a polymer with a MFR of 0.5–10, can be selectively visbroken to a MFR of 15–50, preferably 15–40, e.g., about 35, by selection of peroxide type, extruder temperature and extruder residence time without undue experimentation. Sufficient care should be exercised in the practice of the procedure to avoid crosslinking in the presence of an ethylene-containing copolymer; typically, crosslinking will be avoided where the ethylene content of the copolymer is sufficiently low.

The rate of peroxide decomposition is defined in terms of half-lives, i.e. the time required at a given temperature for one-half of the peroxide molecules to decompose. It has been reported (U.S. Pat. No. 4,451,589) for example, that using Lupersol 101 peroxide under typical extruder pelletizing conditions (450° F., 21/2 minutes residence time), only $2\times10^{-13}$% of the peroxide would survive pelletizing.

In general, the prodegradant should not interfere with or be adversely affected by commonly used polypropylene stabilizers and should effectively produce free radicals that upon decomposition initiate degradation of the polypropylene moiety. The prodegradant should have a short enough half-life at a polymer manufacturing extrusion temperatures, however, so as to be essentially entirely reacted before exiting the extruder. Preferably they have a half-life in the polypropylene of less than 9 seconds at 550° F. so that at least 99% of the prodegradant reacts in the molten polymer before 1 minute of extruder residence time. Such prodegradants include, by way of example and not limitation, the following: 2,5-dimethyl 2,5bis-(t-butylperoxy) hexyne-3 and 4 methyl 4 t-butylperoxy- 2 pentanone (e.g. Lupersol 130 and Lupersol 120 respective available from Lucidol Division, Penwalt Corporation, 3,6,6,9,9-pentamethyl-3-(ethyl acetate) 1,2,4,5-textraoxy cyclononane (e.g., USP-138 from Witco Chemical Corporation), 2,5-dimethyl-2,5 bis-(t-butylperoxy) hexane (e.g., Lupersol 101) and alpha, alpha' bis-(tert-butylperoxy) diisopropyl benzene (e.g., Vulcup R from Hercules Inc.). Preferred concentration of the free radical source prodegradants are in the range of from about 0.01 to 0.4 percent based on the weight of the polymer(s). Particularly preferred is Lupersol 101 peroxide wherein the peroxide is sprayed onto or mixed with the propylene polymer at a concentration of about 0.1 wt. % prior to their being fed to an extruder at about 230° C., for a residence time of about 2 to 3 minutes. Extrusion processes relating to the treatment of propylene-containing polymers in the presence of an organic peroxide to increase melt flow rate and reduce viscosity are known in the art and are described, e.g., in U.S. Pat. Nos. 3,862,265; 4,451,589 and 4,578,430.

The conversion of the propylene polymer material composition from pellet or flake form to fiber form is accomplished by any of the usual spinning methods well known in the art. Since such propylene polymer material can be heat plasticized or melted under reasonable temperature conditions, the production of the fiber is preferably done by melt spinning as opposed to solution processes.

In the process of melt spinning, the polymer is heated in an extruder to the melting point and the molten polymer is pumped at a constant rate under high pressure through a spinnerette containing a number of holes; e.g., having a length to diameter ratio greater than 2. The fluid, molten polymer streams emerge downward from the face of the spinnerette usually into a cooling stream of gas, generally air. The streams of molten polymer are solidified as a result of cooling to form filaments and are brought together and drawn to orient the molecular structure of the fibers and are wound up on bobbins.

The drawing step may be carried out in any convenient manner using techniques well known in the art such as passing the fibers over heated rolls moving at differential speeds. The methods are not critical but the draw ratio (i.e., drawn length/undrawn length) should be in the range of about 1.5 to 7.0:1, preferably about 2.5 to 5.0:1; excessive drawing should be avoided to prevent fibrillation. The fibers are combined to form yarns which are then textured to impart a crimp therein. Any texturizing means known to the art can be used to prepare the yarns of the present invention, including methods and devices for producing a turbulent stream of fluid, U.S. Pat. No. 3,363,041. Crimp is a term used to describe the waviness of a fiber and is a measure of the difference between the length of the unstraightened and that of the straightened fibers. Crimp can be produced in most fibers using texturizing processes. The crimp induced in the fibers of the present invention can have an arcuate configuration in three axes (such as in an "S") as well as fibers possessing a sharp angular configuration (such as a "Z"). It is common to introduce crimp in a carpet fiber by the use of a device known as a hot air texturizing jet. For production of cut staple yarn, crimp also can be introduced using a device known as a stuffer box. After crimp is imposed on the yarn, it is allowed to cool, it is taken from the texturizing region with a minimum of tension and wound up under tension on bobbins.

The yarn is preferably twisted after texturizing. Twisting imparts permanent and distinctive texture to the yarn and to carpet incorporating twisted yarn. In addition, twisting improves tip definition and integrity; the tip referring to that end of the yarn extending vertically from the carpet backing and visually and physically (or texturally) apparent to the consumer. Twist is ordinarily expressed as twists per inch or TPI. In the carpet yarn of the prior art, employing a polyolefin such as polypropylene homopolymer, yarn diameter decreases as TPI increases. As a result, it is necessary to incorporate more individual yarn tufts, or face yarn, to maintain carpet aesthetics using a yarn with a high number of TPI. However, utilizing the compositions of the present invention to produce fiber, yarn and carpeting, the fiber and resulting yarn is capable of high shrinkage levels. Therefore, after plying and heat setting of such yarns, TPI increase and the yarn diameter also increases as a consequence of shrinkage. It is possible to set the level of TPI independently by taking into consideration the shrinkage of the yarn composition on heat setting and adjusting the initial value of TPI. Similarly, denier is affected by shrinkage, but appropriate adjustment can be made to achieve the same final value, if desired. Additionally, individual filaments tend to buckle on contraction and structural limitations cause the buckling to occur outwardly. As a result, after tufting and shearing of loops, the resulting tufts are more entangled. The twisted yarn is thereafter heat treated to set the twist so as to "lock-in" the structure. In yarn made from nylon fiber, twist is retained as a result of hydrogen bonding of the polar groups on the polymer chain. Since polar groups are not available in unmodified polypropylene homopolymer, it is difficult to retain the twist during use and there is a loss of resiliency, tuft coherency and, therefore, of overall appearance. The unique yarn, and carpet made therefrom based on the propylene polymer material disclosed herein, results in an ability to thermally lock in the twist structure during yarn processing. Additionally, yarn based on the blends of the present invention produce a unique material with which one can take advantage of polypropylene homopolymer properties, but with the added feature of improved appearance retention. In the present invention, useful yarn is produced having about 0.5 to about 6.0 twists per linear inch; preferably about 3.5 to about 4.5. Generally, this step utilizes a stream of compressible fluid such as air, steam, or any other compressible liquid or vapor capable of transferring heat to the yarn as it continuously travels through the heat setting device, at a temperature about 110° C. to 170° C.; preferably 120° C. to 140° C.; more preferably about 120° C. to about 135° C. for example about 125° C. This process is affected by the length of time during which the yarn is exposed to the heating medium (time/temperature effect). Generally, useful exposure times are from about 30 seconds to about 3 minutes; preferably from about 45 seconds to about 1½ minutes; for example, about 1 minute.

The twisted yarn is preferably heat treated. Where heat treating of the fibers, filaments or yarn of the present invention is carried out, the temperature of the fluid must be such that the yarn does not melt. If the temperature of the texturizing chamber is above the melting point of the yarn it is necessary to shorten the time in which the yarn dwells in the texturizing region. (One type of heat setting equipment known in the art is distributed by American Superba Inc., Charlotte, N.C.). The yarn of the present invention is advantageously produced when it undergoes shrinkage upon heat setting of from about 10–70%, preferably about 15–65%, most preferably about 20–60%, for example about 25–55%. Yarn based on polypropylene and used commercially is not capable of achieving such desirable levels of shrinkage; typically such yarn of the prior art shrinks about 0–10%.

In polyolefin fibers used to produce yarn and carpeting, there is what can be characterized as a reservoir of available shrinkage which is determined by the thermal characteristics of the composition and the processing conditions. Prior art fibers based on polypropylene homopolymer require sufficient thermal treatment during crimping and texturing such that the shrinkage upon heat setting is very low, for example 2–5%. In contrast, the compositions of the present invention are capable of being textured and crimped to desired levels at lower temperatures leaving a greater amount of residual shrinkage to be exerted during heat setting.

However, it is possible to modify the shrinkage response of the fibers and yarn of the present invention by operating at higher temperatures during texturing and crimping. Thus, the shrinkage characteristics of the carpet yarn of the invention, and its related properties of twist and twist retention can be selectively modified; such capabilities are not present in prior art polyolefin fibers and carpet yarn.

In the production of a carpet yarn, there are typically from about 50 to 250 fibers or filaments which are twisted together and bulked; preferably from about 90 to about 120 fibers; for example about 100 filaments.

The blends herein based on propylene polymer material display a lowering of the heat softening temperature and a broadening of the thermal response curve as measured by differential scanning calorimetry (DSC) as a consequence of the presence of sPP. Typically, isotactic homopolymer polypropylene displays a sharp melting peak in a DSC test at about 159° C. to 169° C., for example about 162° C. Heat setting yarn based on such a polymer requires precise temperature control to avoid melting of the fiber (which would destroy the fiber integrity) while at the same time operating at a sufficiently high temperature in an attempt to soften and thereby thermally lock in fiber twist, as well as to relieve stress in the fiber. Yarn based on compositions of the propylene polymer material of the present invention display a broadened thermal response curve. Such modified thermal response allows processing of such materials and compositions at a lower heat setting temperature while retaining yarn strength and integrity. It should be appreciated that in blend compositions including significant amounts of isotactic polypropylene homopolymer the yarn twist heat setting temperature should be sufficiently high to heat set the isotactic homopolymer component. These advantageous features are obtained and the composition can be processed using well known and efficient equipment developed over many years for the manufacture of yarn, fabric and carpet based on isotactic polypropylene homopolymer.

Conventional additives may be blended with the polymer(s) used to produce the resilient yarn of the invention. Such additives include stabilizers, antioxidants, antislip agents, flame retardants, lubricants, fillers, coloring agents, antistatic and antisoiling agents, and the like.

Filament, fiber and yarn dimensions are typically expressed in terms of denier. The term denier is a well known term of art defined as a unit of fineness for yarn equal to the fineness of a yarn weighing one gram for each 9,000 meters of length; accordingly, 100-denier yarn is finer than 150-denier yarn. Useful filaments and yarn of the present invention include those with denier before heat-setting in the range of about 500 to about 10,000; preferably from about 1,000 to about 4,200; more preferably 1,000 to 2,500. In addition to carpeting, the yarns of the present invention find utility in applications such as nonwovens, high gloss nonwovens and woven fabrics for upholstery, in carpet backing and in applications including geotextiles.

The present invention is particularly useful in view of the fact that equipment and technology developed over many years and directed to polypropylene homopolymer, especially for the manufacture of carpet, can be adapted according to the teachings herein to produce yarn and carpet with enhanced properties.

The expression "consisting essentially of" as used in this specification excludes an unrecited substance at a concentration sufficient to materially affect the basic and novel characteristics of the claimed invention.

The following examples are provided to illustrate, but not limit, the invention disclosed and claimed herein:

Example 1

A syndiotactic propylene homopolymer (sPP) having a pentad fraction greater than 0.7 is blended with crystalline isotactic homopolymer polypropylene (iPP) at concentrations of 20–45 parts sPP and 80–55 parts iPP (at 5 part intervals) to prepare fibers, yarn and carpeting. The sPP is visbroken to a MFR of 20–35 from initial, as polymerized, values of 3.0–6.0. Visbreaking is carried out by spraying 0.1 wt. % of the Lupersol 101 peroxide (present on a polypropylene carrier) onto the polymer flakes or particles following polymerization, and extruding the peroxide-flake mixture at about 360° F. (232° C.), with a residence time of about 2–3 minutes. The iPP is a commercially available product with a Melt Flow Rate (MFR)=35.

The process to make carpet from the polymer compositions includes the steps of:

1. Spinning—molten polymer composition is made into filaments;
2. Drawing—filaments are stretched;
3. Texturizing—filaments are folded and optionally lightly air entangled to add bulk.

By carrying out these steps with several filaments at the same time flat yarn is produced. Flat yarns were twisted together to produce a twisted yarn which is heat set; the heat set and twisted yarn is tufted, and a backing and latex added.

The latex is oven dried under standard conditions to produce a carpet.

Carpet production is carried out using commercial equipment known as a Barmag system. Three extruders are operated in tandem for the production of filaments. Each of the extruders is operated at a pressure of 120 Bar, at extrusion temperatures (° C.) of 200, 205, 210, and 215 in each of the four zones. (The heat transfer fluid is controlled at 225° C. to generate these temperature profiles).

The filaments are drawn at a draw ratio of about 3.8:1 and a draw temperature of 120° C. Texturizing is carried out at 120° C. to 140° C. and at an air pressure of 75–95 psi.

Blend compositions are prepared using two methods: (1) preblending pellets of each component and pelletizing the mixture for subsequent extrusion to produce filaments; and (2) blending of pellets of each component at the filament extrusion stage; the methods produce substantially equivalent results. Preblending is conveniently accomplished using a Henschel blender followed by extrusion of strands at about 200°–220° C. and chopping of the strands into pellets.

Flat yarn produced from the blends results in acceptable yarn properties including: tenacity (g/denier), elongation (%), and denier. Carpeting produced with compositions of the invention are tested for performance in a Hexapod Tumble Test typically used in the art to evaluate carpet performance. For comparison purposes, also included is a commercially produced carpet sample prepared from unblended iPP.

The Hexapod Carpet Test procedure is as follows:

Test specimens are subjected to 8,000 cycles (residential carpet) or 12,000 cycles (commercial carpet) of "Hexapod" tumbling, modified head, removing the specimen every 2,000 cycles for restoration by vacuuming, using a Hoover upright vacuum cleaner (Model 1149), making four (4) forward and backward passes along the length of the specimen. The sample is assessed using the draft ISO conditions, day-light equivalent D65, vertical lighting giving 1500 lux at the carpet surface, viewing at an angle of 45 degrees from 1½ meter distance, judging from all directions. The sample is also measured for total thickness before and after testing to obtain a thickness retention value.

| Rating keys: | |
|---|---|
| OVERALL APPEARANCE | COLOR CHANGE |
| 5 = None/very slight change | 5 = Negligible/no change |
| 4 = Slight change | 4 = Slight change |
| 3 = Moderate change | 3 = Moderate change |
| 2 = Severe change | 2 = Considerable change |
| 1 = Very severe change | 1 = Severe change |

Test results are reported as: Overall Appearance, Color Change, and Thickness Retained (%).

The Hexapod test results demonstrate improvements as measured by pile height retained, overall appearance and color change compared to unblended iPP.

Example 2

Shrinkage experiments are carried out using yarn produced on commercial equipment as described in Example 1 hereinabove to further characterize yarn performance. The yarn samples are evaluated in laboratory tests to measure twist retention and shrinkage as a function of heat set temperature. Without intending to be bound by theory, it is proposed that improved carpet appearance is characterized by improved tuft definition and twist retention.

Twist is introduced and retention and shrinkage measured in the laboratory as follows:

Thermal Shrinkage

Samples are treated using a "Thermal Shrinkage Tester" radiant heat oven manufactured by Testrite Ltd. A sample of yarn is clamped at one end and its other, free end, is draped over a drum which is free to rotate on a ball bearing; a pointer on the drum can be set to zero at the start of the test. To the free end of the sample a 9 g weight is attached corresponding to 0.005 g/denier for 1800 denier yarn. The drum element, including the yarn, is placed in an oven at the desired temperature and shrinkage of the yarn is recorded (based on the pointer movement) which is observed at the oven temperature after 3 minutes elapsed time. Percent shrinkage=[(initial length–final length)/initial length]×100.

Twist Retention Test-Method A

Samples are tested using a "Twist Inserter," Model ITD-28, manufactured by Industrial Laboratory Equipment Co. A length of yarn is inserted into the Twist Inserter and 4.50 twists per inch imposed on the yarn by turning the crank of the tester. The ends of the yarn sample are tied-off and the twisted sample mounted on a "coupon" with the free ends fixed adjacent one another on the coupon. The twist is heat set at the indicated temperature for 10 minutes in a forced hot air oven after which the sample is removed and cooled at room temperature. One end of the sample is fixed and a 20 g weight attached to the other end which is permitted to hang freely for approximately 18 hours. At the end of that time, the weight is removed and the sample allowed to recover at room temperature for one hour. The yarn is then re-installed in the Twist Inserter and the number of turns of the crank required to remove the residual twist (yarn filaments substantially parallel) is determined. Percent Twist Retention is calculated as=(Number of Twists Remaining/Initial Number of Twists)×100.

Yarn based on compositions of the present invention demonstrate superior twist retention compared to isotactic polypropylene homopolymer. Compositions of the present invention result in greater shrinkage at elevated temperatures.

Example 3

Thermal analysis tests are conducted using a differential scanning calorimeter (DSC). Samples including unblended iPP and sPP as well as blends, are pressed into film form and tested on an instrument manufactured by DuPont (Model 2100) or an instrument manufactured by Perkin-Elmer (model DSC 7). In this test a small polymer sample (about 4 to 6 mg) is heated or cooled at a controlled rate (typically 20° C./min.) in a nitrogen atmosphere. The sample is heated or cooled under controlled conditions to measure melting, crystallization, glass transition temperatures, heat of fusion and crystallization, and to observe the breadth and shape of the melting or crystallization response. Tests are conducted on the samples of Example 1. The response curve for a sample can be affected by its heat history during preparation in the laboratory or during fiber manufacture as well as multiple heating and cooling cycles during testing; e.g., thermal signatures due to crystalline structures can be enhanced and thermal transitions magnified. Other modifications can occur as a result of the presence of pigments since such additives can act as nucleators.

Testing samples in an initial heating cycle two melting peaks are observed; one at a lower temperature for sPP, e.g., 140°–150° C., and one at a higher temperature typical of iPP, e.g., 162° C. Much of the melting response of the sPP is complete as the temperature rises to the level that causes iPP to begin melting. Naturally there is no chemical incompatibility with sPP and iPP and, furthermore, yarn processing conditions can be maintained at levels consistent with existing technology for isotactic polypropylene homopolymer. The thermal response is affected by the concentration of sPP in the blend as well as the presence and concentration of comonomer(s), if any.

EXAMPLE 4

Samples of the compositions of Example 1 are made into saxony-type test carpets and performance is evaluated in walk-out tests. A "walk-out" test refers to placing the samples in an area frequented by regular and heavy foot traffic (e.g., library or office entrance) and, following the estimated and desired number of treads, the samples are evaluated for appearance retention relating to resiliency, tuft tip retention and soiling. Compositions of the present invention are superior to 100% iPP carpet of the prior art.

EXAMPLE 5

In this example samples of yarn are evaluated for shrinkage response. Flat yarn (i.e., not textured) is prepared at various draw ratios. It is observed that undrawn yarn based on unblended iPP has a shrinkage value of 1% at 120° C. to 135° C. Flat yarn drawn at increasing draw ratios shows a shrinkage response at (120° C.–135° C.) that starts at about 10% and decreases to about 4% at the maximum draw ratio. Yarn that is drawn and textured, the latter at 140° C., shows no shrinkage at temperatures of 140° C. or less and 4% at 145° C. This illustrates the effect of processing variations on shrinkage response as well as the limited shrinkage "reservoir" of unblended iPP homopolymer. In contrast, the blends of the invention result in increased shrinkage response. Improved Hexapod texture ratings are obtained for compositions possessing higher shrinkage when fabricated into carpeting.

Example 6

Other polymers and compositions are prepared in order to further define the invention. Tests include the ability of the composition to be spun into fibers, shrinkage response and whether they resulted in improved carpeting relative to iPP alone. Carpet performance is measured in the Hexapod test at 12,000 cycles using the appearance rating criteria; a control carpet of iPP prepared under similar conditions results in an appearance rating of 2.0 in this test. The polymers in this example include random copolymers (syndiotactic and isotactic), including comonomers of ethylene and butene-1 (copolymers and terpolymers) at concentrations of 3.0–8.0 weight percent. Blends are prepared using from 25–45 weight % of the sPP homopolymer and random copolymer. The compositions of the present invention result in improved performance.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. Polyolefin yarn capable of increased shrinkage comprising a continuous strand of multiple monofilament fibers or staple fibers of propylene polymer material consisting essentially of about 10 to about 45 parts by weight of a syndiotactic propylene polymer having a syndiotactic pentad fraction of 0.7 or more, blended with a crystalline, isotactic propylene polymer selected from the group consisting of:

(I) homopolymers of propylene; and (II) random propylene copolymers, terpolymers or mixtures thereof, consisting essentially of from about 80 to about 98.5% of propylene; and from about 1.5 to about 20.0% of at least one comonomer selected from the group consisting of ethylene and $C_4$–$C_8$ alpha-olefins; said copolymer containing from about 2 to about 10% ethylene when said $C_4$–$C_8$ alpha-olefin is not present; and said terpolymer containing from about 0.5 to about 5% ethylene when said $C_4$–$C_8$ alpha-olefin is present, wherein said amounts are expressed as weight %.

2. The yarn of claim 1 wherein said propylene polymer materials are homopolymers of propylene.

3. The yarn of claim 2 comprising from about 50 to about 250 fibers, said fibers twisted together, bulked and heat set to form a carpet yarn.

4. The yarn of claim 3 having from about 0.5 to about 6.0 twists per linear inch.

5. The yarn of claim 3 wherein said fibers are pigmented.

6. The yarn of claim 1 wherein said syndiotactic propylene polymer material is a random terpolymer.

7. The yarn of claim 1 wherein said isotactic propylene polymer material is a random terpolymer.

8. A polyolefin pile fabric of increased resiliency and appearance retention comprising a backing and a yarn secured to said backing and extending outwardly therefrom, said yarn comprising a continuous strand of multiple monofilament fibers or staple fibers of propylene polymer material consisting essentially of about 10 to 45 parts by weight of a syndiotactic propylene polymer having a syndiotactic pentad fraction of 0.7 or more, blended with a crystalline, isotactic propylene polymer selected from the group consisting of:

(I) homopolymers of propylene; and (II) random propylene copolymers, terpolymers or mixtures thereof, consisting essentially of from about 80 to about 98.5% of propylene; and from about 1.5 to about 20.0% of at least one comonomer selected from the group consisting of ethylene and $C_4$–$C_8$ alpha-olefins; said copolymer containing from about 2 to about 10% ethylene when said $C_4$–$C_8$ alpha-olefin is not present; and said terpolymer containing from about 0.5 to about 5% ethylene when said $C_4$–$C_8$ alpha-olefin is present, wherein said amounts are expressed as weight %.

9. The pile fabric of claim 8 wherein said yarn is twisted, bulked and heat set.

10. The pile fabric of claim 9 wherein said propylene polymer material has dispersed therein at least one additive selected from the group consisting of colorants, fillers, flame retardants, antistatic agents and antisoiling agents.

11. The pile fabric of claim 10 wherein said propylene polymer materials are propylene homopolymers and said blend has been visbroken to a melt flow rate of from about 5 to 100.

12. A material selected from the group consisting of woven textile, nonwoven textile and geotextile prepared from a polyolefin fiber or yarn capable of increased resiliency and shrinkage comprising propylene polymer material consisting essentially of about 10 to 45 parts by weight of a syndiotactic propylene polymer having a syndiotactic pentad fraction of 0.7 or more, blended with a crystalline, isotactic propylene polymer selected from the group consisting of:

(I) homopolymers of propylene; and (II) random propylene copolymers, terpolymers or mixtures thereof, consisting essentially of from about 80 to about 98.5% of propylene; and from about 1.5 to about 20.0% of at least one comonomer selected from the group consisting of ethylene and $C_4$–$C_8$ alpha-olefins; said copolymer containing from about 2 to about 10% ethylene when said $C_4$–$C_8$ alpha-olefin is not present; and said terpolymer containing from about 0.5 to about 5% ethylene when said $C_4$–$C_8$ alpha-olefin is present, wherein said amounts are expressed as weight %.

13. The material of claim 12 wherein said propylene polymer materials are propylene homopolymers.

14. The pile fabric of claim 8 wherein said backing comprises a scrim having needled thereto a web of staple fibers.

15. The pile fabric of claim 8 wherein said pile is formed by yarn tufts extending from said backing and forming a fabric face, further including a backsizing coating, said coating serving to lock substantially each said yarn tuft into said fabric backing.

16. The pile fabric of claim 15 wherein said tufts are yarn loops.

17. The pile fabric of claim 8 including a secondary backing layer secured to said fabric.

18. A saxony carpet comprising a primary backing and twisted, evenly sheared, heat-set pile yarn, said yarn being in the form of individual lengths of plied yarn or tufts, each of which is attached to and projects upwardly from said backing and terminates as a cut end, wherein said pile yarn is the yarn of claim 1.

19. The yarn of claim 18 wherein said yarn is comprised of bulk continuous fibers or staple fibers.

* * * * *